United States Patent [19]

Werner

[11] Patent Number: 4,873,765

[45] Date of Patent: Oct. 17, 1989

[54] METHOD OF MAKING AN ELECTRICAL CONNECTOR

[75] Inventor: Walter M. Werner, Downingtown, Pa.

[73] Assignee: AMP Incorporated, Harrisburg, Pa.

[21] Appl. No.: 238,020

[22] Filed: Aug. 29, 1988

[51] Int. Cl.[4] ..... H01R 43/00

[52] U.S. Cl. ..... 29/876; 29/882

[58] Field of Search ..... 29/874–876, 29/882; 439/886, 887

[56] References Cited

U.S. PATENT DOCUMENTS 4,290,665 9/1981 Krasnov et al. ..... 439/887

4,626,126 12/1986 Suchdev et al. .

*Primary Examiner*—Timothy V. Eley

*Assistant Examiner*—Taylor J. Ross

*Attorney, Agent, or Firm*—Allan B. Osborne

[57] ABSTRACT

A method for making an electrical connector. More particularly, a slug of conductive material is impact-extruded into a form having a wire barrel at one end and at the other end, outwardly extending tang and flat blade. Simple machine operations including cutting, punching, coining, and inserting complete the form into an electrical connector.

3 Claims, 3 Drawing Sheets

METHOD OF MAKING AN ELECTRICAL CONNECTOR

FIELD OF THE INVENTION

This invention relates to a method of making an electrical connector by impact extrusion, forming and machining.

BACKGROUND OF THE INVENTION

It is known from U.S. Pat. No. 4,626,126 to make a connector by first extruding a socket from one end of a slug which had been work hardened. The socket is then annealed to soften the socket to adapt it for being crimped about an electrical cable. A tongue and jaw are then extruded from the opposite end of the slug with the extrusion causing a further and desirable work hardening to the tongue and jaw to provide wear resistance thereto. Finally, a recess and protrusion are extruded in and from the tongue to provide retaining means with another.

It is now proposed to provide an improved method of making an electrical connector.

SUMMARY OF THE INVENTION

According to the invention, a method of making an electrical connector includes the step of impact-extruding a slug of conductive material into a form having a cylindrical wire barrel at one end and an outwardly extending, parallel and spaced apart crescent shaped tang and flat blade at another end. The tang is shortened by cutting. A crescent or arcuate-shaped recess is then coined into the blade and after that, a hole is punched through the blade adjacent the recess. Further, one corner of the free end of the blade is sheared and the free end slotted with the slot being parallel to the plane of the blade. The connector is completed by inserting an upstanding pin into the punched hole in the blade.

DESCRIPTION OF THE INVENTION

Figures 1, 2:
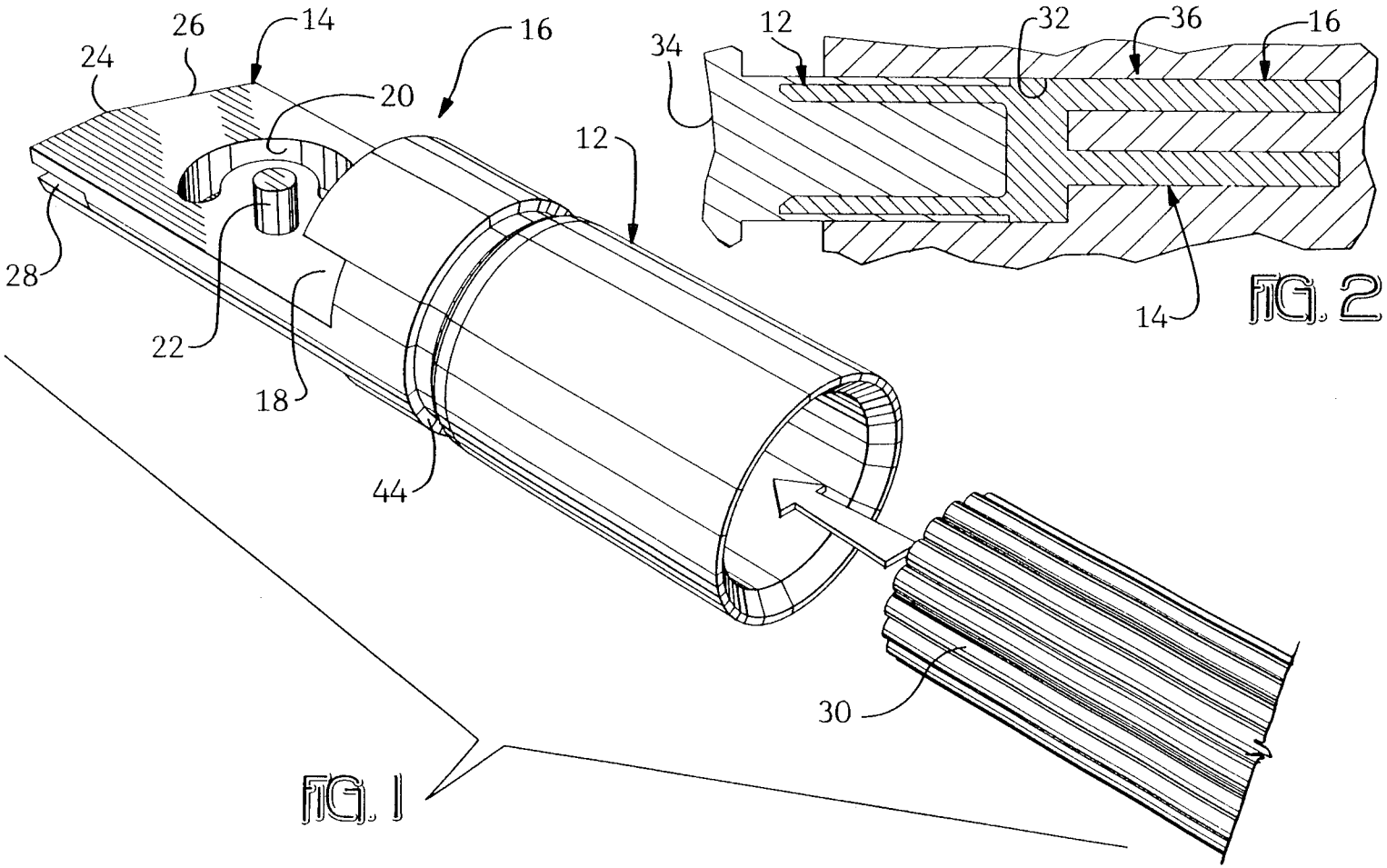
FIG. 1 is a three dimensional view of an electrical connector made by the method of the present invention.
FIG. 2 is a sectional view showing the impact extrusion step in forming the connector.

Electrical connector 10 shown in FIG. 1 is used as an illustration of the method of the prsent invention. Connector 10 includes a cylindrical wire barrel 12 at one end. As will be shown later on, barrel 12 can include an insulation support section 44 (FIG. 8) at the free end thereof. The other end of connector 10, generally referred to as the forward end, includes flat blade 14 and tang 16 which is parallel to and spaced from blade 14. Tang 16 is much shorter than blade 14 and is crescent-shaped; i.e., the outer surface 16-a is curved. Space 18 between blade 14 and tang 16 receives a blade 14 on a like connector 10 (not shown). An arcuate-shaped recess 20 and upstanding pin 22 are provided in blade 14 intermediate free end 24 of blade 14 and wire barrel 12. One side of free end 24 is angled rather than squared off to provide an angled lead-in 26 for blade 14 as it enters space 18 on a like connector 10. Further, free end 24 is provided with slot 28 to provide resiliency thereto.

As is well known in the art, cable 30 is inserted into wire barrel 12 and crimped or otherwise secured therein. Two like connectors 10 are engaged by respective pins 22 being placed in respective recesses 20 and the connectors rotated so that respective free ends 24 enter respective spaces 18. The resilient deformation of free ends 24 in spaces 18 retain the connector 10 in a mated condition (not shown).

The method of making a connector 10 according to the method of the present invention includes the preliminary steps (not shown) of cutting a slug of conductive material; e.g. copper, weighting and then annealing it. The first step of the present invention, shown in FIG. 2 is placing the slug in cavity 32 and impacting it by ram 34. The impact causes the slug to extrude into form 36 shown; i.e., a form having wire barrel 12 at one end and an elongated tang 16 and blade 14 at the other end.

Figure 3:
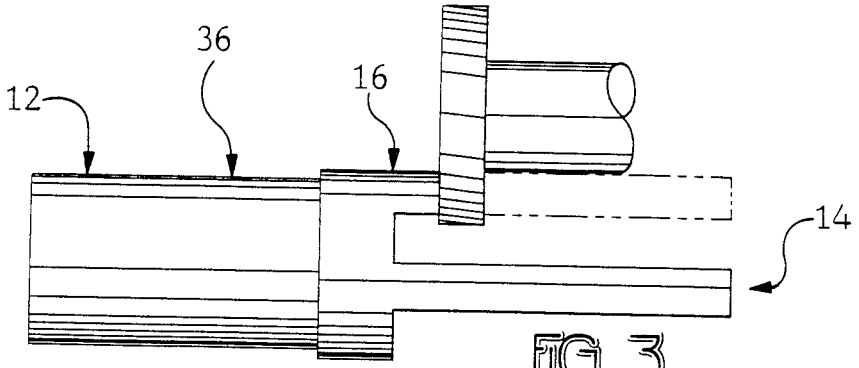
FIG. 3 shows the step of shortening the tang at one end of the connector.
Figure 4:
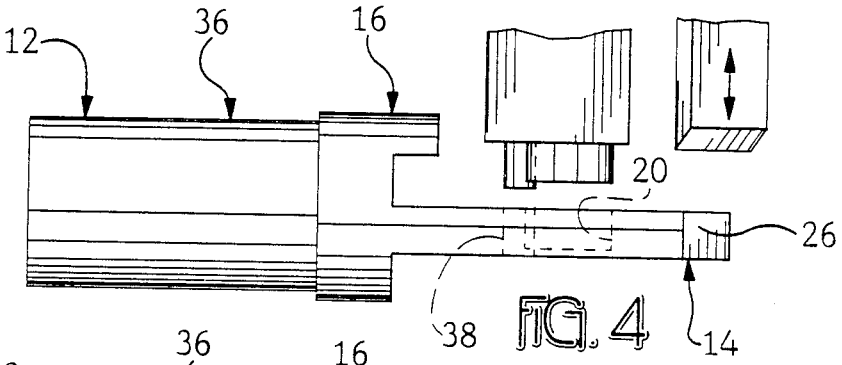
FIG. 4 shows the step of coining a recess and punching a hole in the blade.

In the next step, elongated tang 16 is shortened; e.g., by cutting as shown in FIG. 3. This step opens the way to punch or drill hole 38 in blade 14 and coin out recess 20. Additionally, a corner is sheared off blade 14 to provide lead-in 26.

Figure 5:
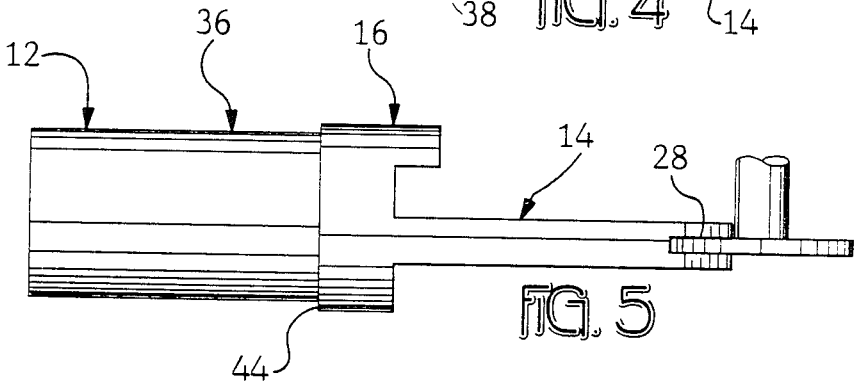
FIG. 5 shows the step of machining a slot in the blade.

Slot 28 is cut into the face of free end 24 as shown in FIG. 5.

After the completion of the step shown in FIG. 5, pin 22 (FIG. 1) may be placed in hole 38 to complete one form of connector 10 which is sized to receive a given cable size; e.g., 400 MCM.

Figure 6:
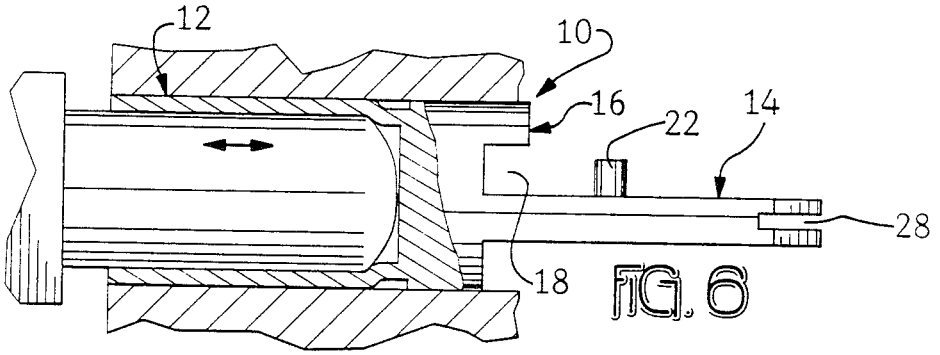
FIG. 6 shows an added step of expanding the wire barrel to provide one form of the connector.
Figure 7:
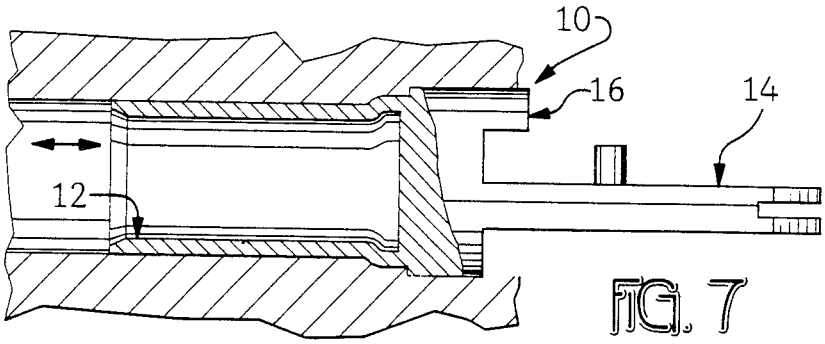
FIG. 7 shows the step of reducing the wire barrel.
Figure 8:
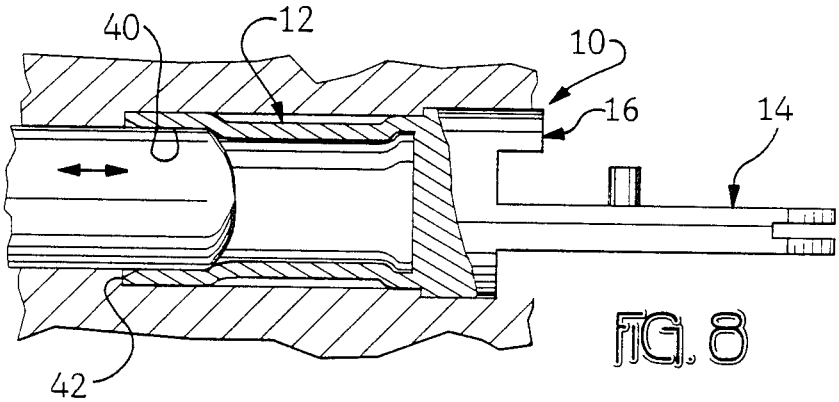
FIG. 8 shows the step of expanding the insulation barrel to produce another form of the connector.

If connector 10 is to be used with a larger size cable 30; e.g., 500 MCM, barrel 12 may be expanded as shown in FIG. 6 and also FIG. 1. If on the other hand connector 10 is to be used with a smaller size cable 30; e.g., 250–350 MCM, barrel 12 is first reduced in diameter as shown in FIG. 7 and insulation support section 40 formed as shown in FIG. 8 by enlarging free end 42 of wire barrel 12.

Figure 9:
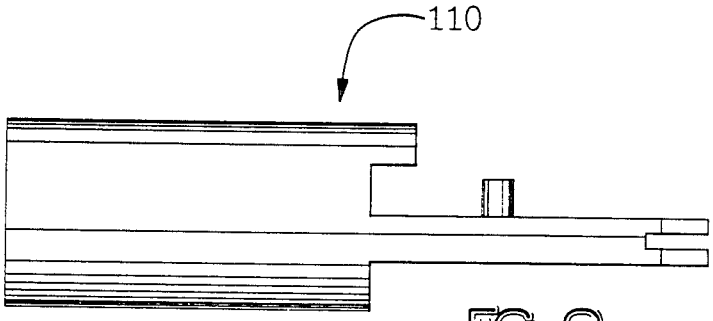
FIG. 9 shows an alternate form of the connector.

As shown in FIG. 1–8, a rearwardly facing annular shoulder 44 is provided on connector 10 adjacent wire barrel 12. FIG. 9 illustrates a connector 110 formed without such a shoulder.

As is readily apparent to those skilled in the art, the above described method is well suited to automation with minimal human intervention.

As can be discerned, a method of making an electrical connector has been disclosed. The basic step of impact extrusion produces a form which only requires straightforward forming and machining operations to complete the operation.

I claim:

1. A method for making an electrical connector comprising the steps of:

impact-extruding a slug of conductive material into a form having a cylindrical wire barrel at one end and at the other end an outwardly extending tang having a curved surface and an outwardly extending flat blade, said tang and blade overlying and spaced from each other;

shortening said tang so that only a short portion thereof overlies said blade;

coining an arcuate recess in said blade intermediate a free end thereof and said wire barrel and on a surface facing said tang;

punching a hole through said blade adjacent said recess;

shearing a corner off of said blade at the free end;

cutting a slot into said blade at the face of said free end, said slot being parallel to the plane of said blade; and inserting an upstanding pin in said punched hole.

2. The method of making an electrical connector according to claim 1 further including the step of expanding the wire barrel.

3. The method according to claim 1 further including the steps of:

reducing the diameter of said wire barrel; and expanding a section of said wire barrel at a free end thereof to provide an insulation support section.

* * * * *